US007718013B2

(12) United States Patent
Jonsson

(10) Patent No.: US 7,718,013 B2
(45) Date of Patent: May 18, 2010

(54) APPARATUS AND A METHOD FOR CLEANING ENCLOSED SPACES

(76) Inventor: Hallgrimur Jonsson, Austurvegur 5, IS-710 Seydisfjordur (IS)

( * ) Notice: Subject to any disclaimer, the term of this patent is extended or adjusted under 35 U.S.C. 154(b) by 938 days.

(21) Appl. No.: 10/498,196

(22) PCT Filed: Oct. 16, 2002

(86) PCT No.: PCT/IS02/00017

§ 371 (c)(1),
(2), (4) Date: Jun. 9, 2004

(87) PCT Pub. No.: WO03/051541

PCT Pub. Date: Jun. 26, 2003

(65) Prior Publication Data

US 2005/0011545 A1 Jan. 20, 2005

(30) Foreign Application Priority Data

Dec. 19, 2001 (IS) ..... 6208

(51) Int. Cl.
*B08B 9/00* (2006.01)
*B08B 3/00* (2006.01)

(52) U.S. Cl. ..... 134/167 R; 134/22.1; 134/34; 134/166 R

(58) Field of Classification Search ..... 134/167 R, 134/34, 22.1, 166 R
See application file for complete search history.

(56) References Cited

U.S. PATENT DOCUMENTS 2,023,007 A * 12/1935 Delano ..... 248/94
2,207,697 A 7/1940 Kendall
3,311,500 A * 3/1967 Seto ..... 134/23
3,439,689 A 4/1969 Zadron et al.
3,985,572 A * 10/1976 Petermann et al. ..... 134/34
4,163,455 A * 8/1979 Hebert et al. ..... 134/167 R
H300 H * 7/1987 Hearst ..... 134/22.19
5,090,351 A * 2/1992 Goldbach et al. ..... 114/65 R (Continued)

FOREIGN PATENT DOCUMENTS

EP 0 638 371 2/1995

(Continued)

OTHER PUBLICATIONS

International Search Report.

*Primary Examiner*—Michael Kornakov
*Assistant Examiner*—Stephen Ko
(74) *Attorney, Agent, or Firm*—Fish & Richardson P.C.

(57) ABSTRACT

The invention relates to an apparatus and a method to clean enclosed spaces. The apparatus consists of an inlet-pipe (1) for cleaning-medium, equipped with thread (10) on outside where a vertical displacement nut (12) is located, which moves vertically when the drive-shaft (6), which is directly connected to a cleaning-medium distributor (18) and, indirectly to a shielding-pipe (8) and nozzle-arms (15, 21), is rotated by a motor (3). The upper nozzle-arms (21) and the vertical displacement nut (12) are interconnected through vertical displacement arms (14) so that the nozzle-arms move vertically and circularly in concert with the vertical displacement nut (12) when the motor rotates the drive-shaft (6). The method relates to cleaning of various enclosed spaces with different cleaning media and is effective for cleaning enclosed spaces such as storage tanks.

7 Claims, 4 Drawing Sheets

U.S. PATENT DOCUMENTS 5,174,730 A 12/1992 Nieuwkamp et al.
5,351,885 A * 10/1994 Manabe ..... 239/73
5,352,298 A * 10/1994 Moulder ..... 134/22.18
5,401,379 A * 3/1995 Mazzochi ..... 205/99
5,718,382 A * 2/1998 Jaeger ..... 239/227
6,021,793 A * 2/2000 Moulder ..... 134/167 R
6,116,858 A * 9/2000 Narabayashi ..... 417/54

FOREIGN PATENT DOCUMENTS

GB 1 525 295 9/1978
WO WO 01/74495 10/2001

* cited by examiner

APPARATUS AND A METHOD FOR CLEANING ENCLOSED SPACES

TECHNICAL FIELD

The present invention relates to an apparatus and a method for cleaning enclosed spaces such as storage tanks and related compartments.

BACKGROUND OF THE INVENTION

At present, there is an increased demand for the cleanliness of storage tanks and other containers storing goods such as fuel oil, fish oil and beverages of various types e.g. beer, soda-drinks or milk. The apparatus commercially available for cleaning storage tanks place considerable requirements to the type of space to be washed and cleaned. In the case of storage tanks, the size, position of openings and the presence of columns inside the tank can limit the utility of the apparatus. In many cases, apparatus specific for certain kinds of tanks have to be constructed. In most cases the apparatus operate at high pressure thus making them expensive and bulky. Furthermore, the high pressure involved increases the the risk of explosion in the case of tanks storing explosive and/or inflammable materials.

SUMMARY OF THE INVENTION

The aim of the present invention is to provide an inexpensive and versatile apparatus of simple construction that can be moved between spaces of different kinds and sizes. This aim is achieved by an apparatus equipped with nozzle-arms, that can be adjusted in length and move vertically upwards and downwards with the aid of specifically constructed device for displacement. The rotational movement and vertical displacement are harmonized and stepless. Detectors and switches change the displacement when the limit of vertical displacement is reached. The apparatus can also be controlled from outside, e.g. by a computer. There is no requirement for specific fastening means inside the space to be cleaned and the apparatus operates as one unit located inside the space, except for an inlet for the cleaning-medium and/or device for recycling of the cleaning-medium and optional device for controlling. The placement of openings or the presence of columns in the tank does not influence the usefulness of the apparatus. The device for vertical displacement and the means for adjusting the lenghts of nozzle-arms make it possible to exploit the force of gravity of the cleaning-medium and to operate at a lower pressure than otherwise would be possible, thus enabling the use of inexpensive nozzles and fluid-system.

As the apparatus contains no oil, it is ideal for use in the food and drink industries, where external contamination must be kept to an absolute minimum. Yet another advantage is, that only one operator is required who, if needed, can control several units at a time.

The embodiments of the invention are as characterized in the claims.

BRIEF DESCRIPTION OF THE FIGURES

The invention is further described with references to the following figures.

DETAILED DESCRIPTION OF THE INVENTION

Figure 1:
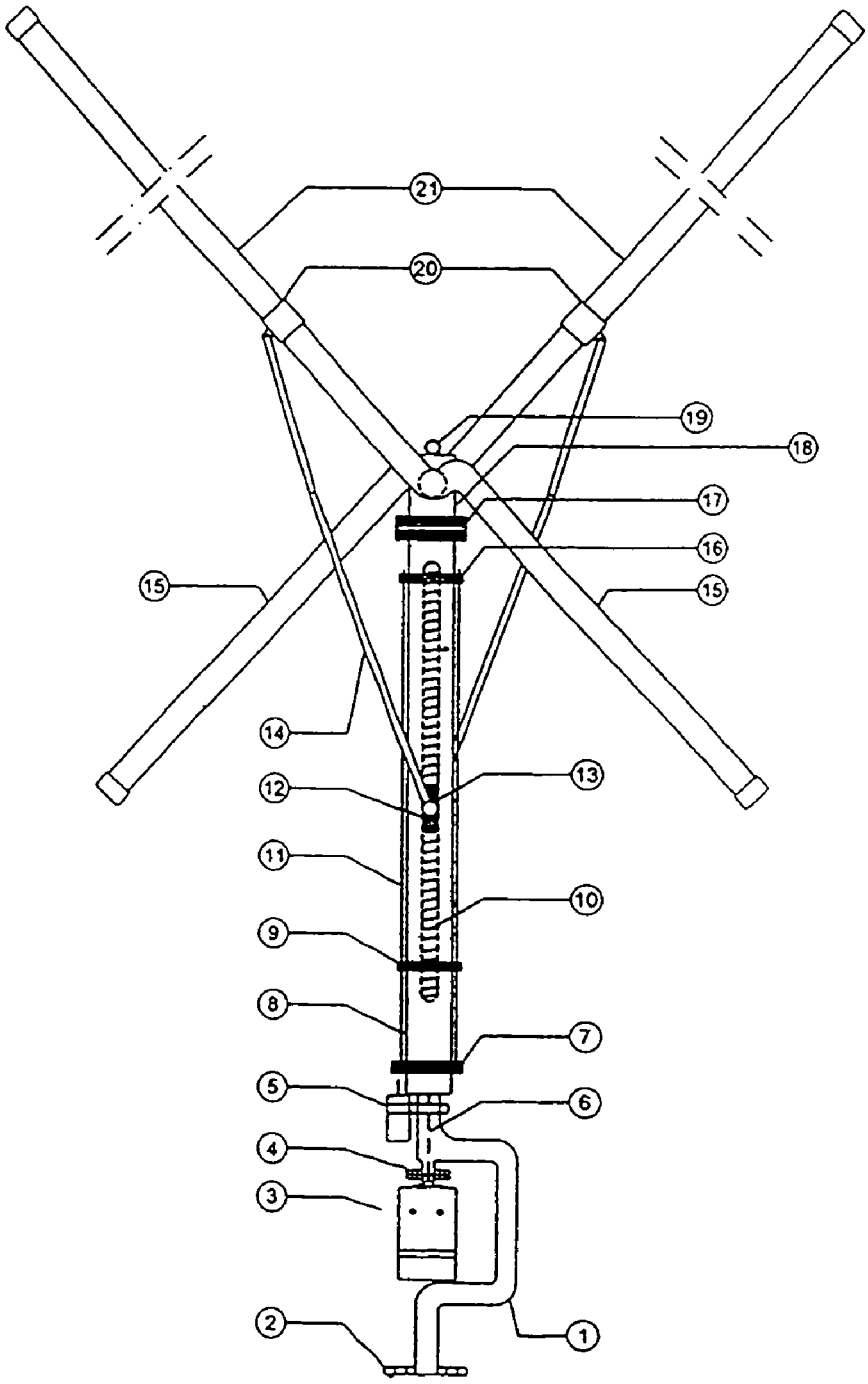
FIG. 1 Side-view of the apparatus (nozzle-arms in ca. 60° position)
Figure 2:
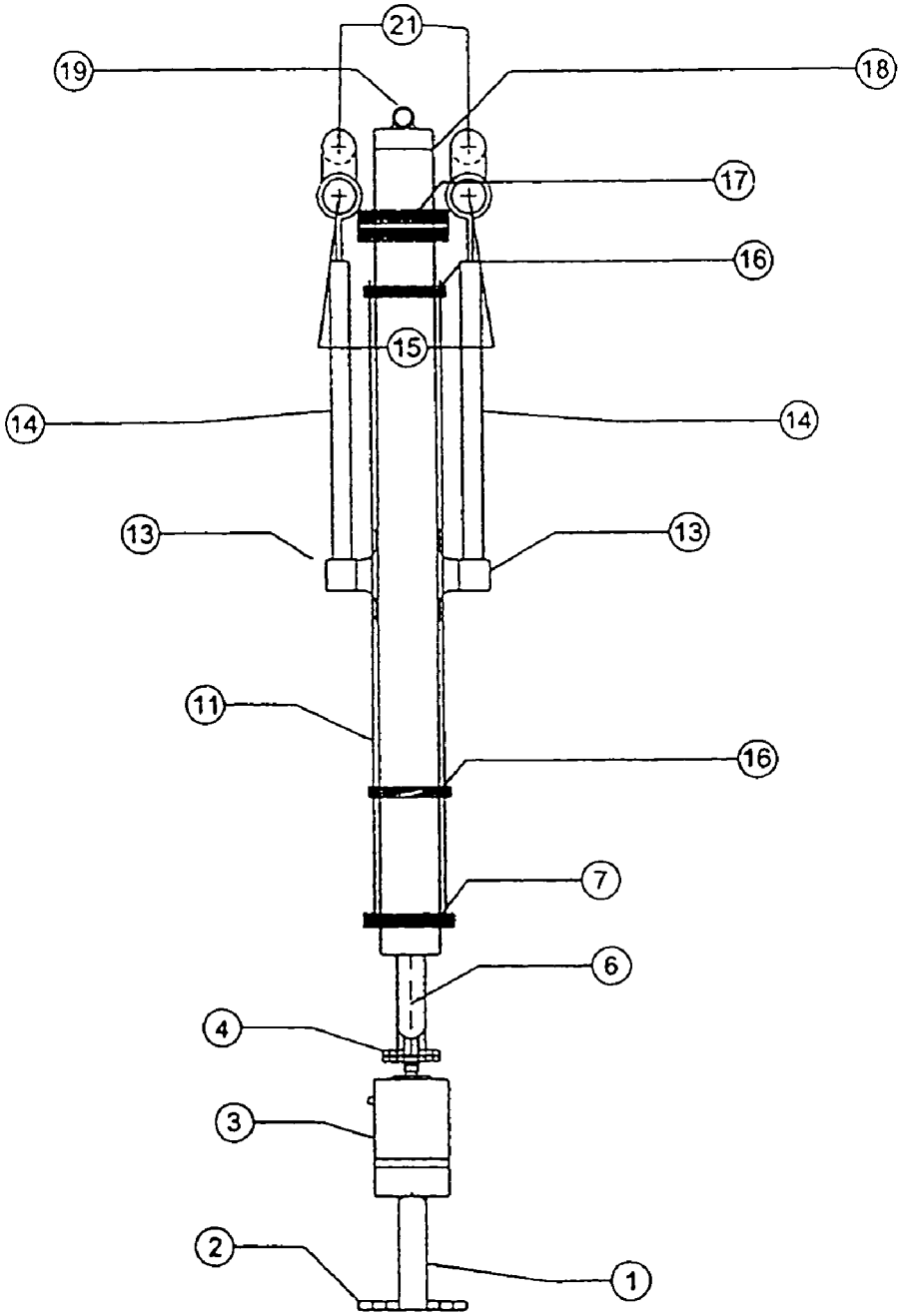
FIG. 2 Side-view of the apparatus (nozzle-arms in horizontal position)
Figure 3:
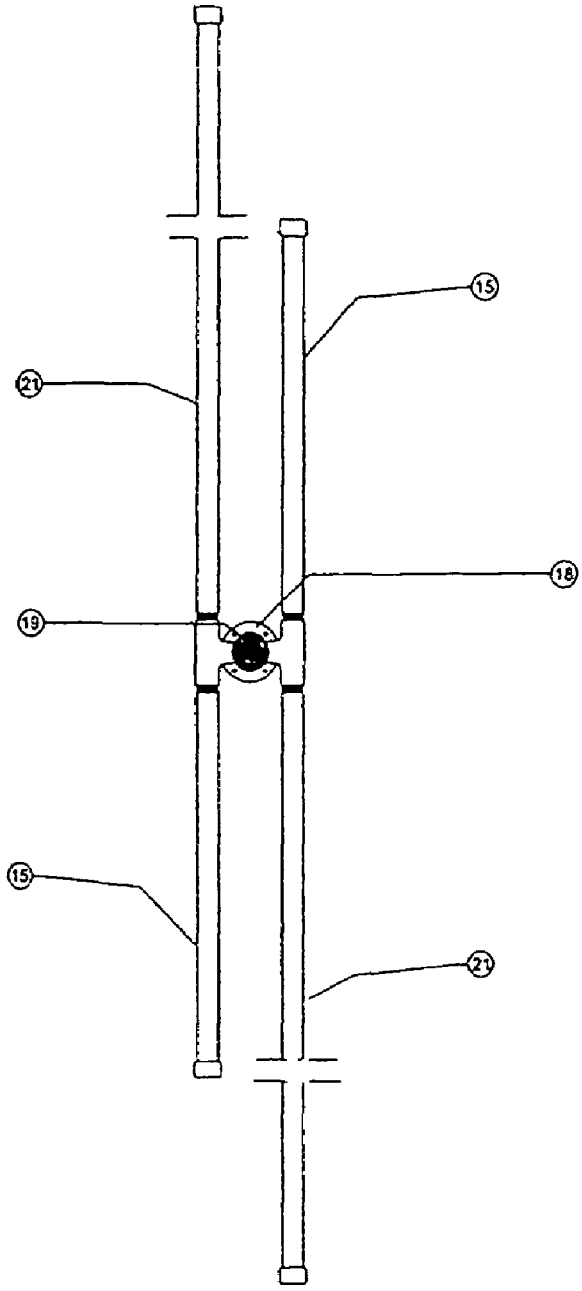
FIG. 3 Shows the apparatus from above (nozzle-arms in horizontal position)

At the lower part of the apparatus is an inlet-pipe (1) where the cleaning-medium is let in. At the upper part, the inlet-pipe is equipped with a thread (10) with a vertical displacement nut (12). Around the inlet-pipe, mainly in the part equipped with the thread, is a shielding-pipe (8), connected to a cleaning-medium distributor (18) through sealing-contactor (17) but the distributor (18) is connected to the nozzle-arms (15, 21) which are adjustable in length. The upper arms (21) and lower arms (15) are one unit; a pipe that transports the cleaning-medium to the nozzles at each end from movable fastening to the distributor located approximately at the middle of the pipe. The vertical displacement arms (14) are connected at one end to the upper arms (21) with clips (20) and at the other end, through slits (22) in the shielding-pipe (8), to fastening-bolts (13) on the vertical displacement nut (12) that sits around the thread (10) on the inlet-pipe. The clips (20) can be moved on the nozzle-arms (21) and the length of the vertical displacement arms (14) can be altered. Inside the inlet-pipe (1), in the upper part, is the drive-shaft (6) that is connected at the lower end to the motor (3) through connecting-flange (4) and at the upper end to the distributor (18) and, indirectly, to the shielding-pipe (8) and nozzle-arms (15, 21). Detectors/stop-rings (9,16) are placed around the shielding-pipe (8) which are interconnected and connected to a contacting-ring (7) with pins (11). The contacting-ring (7) activates/deactivates switch (5) that in turn controls the motor (3). A swivel (19) is intended to fasten (hang up) the apparatus to the enclosed space that is to be cleaned. Similar purpose has the fastening-flange (2) at the lower end of the inlet-pipe that can be placed on a stand on the bottom of the enclosed space or can be fastened in other way.

Figure 4:
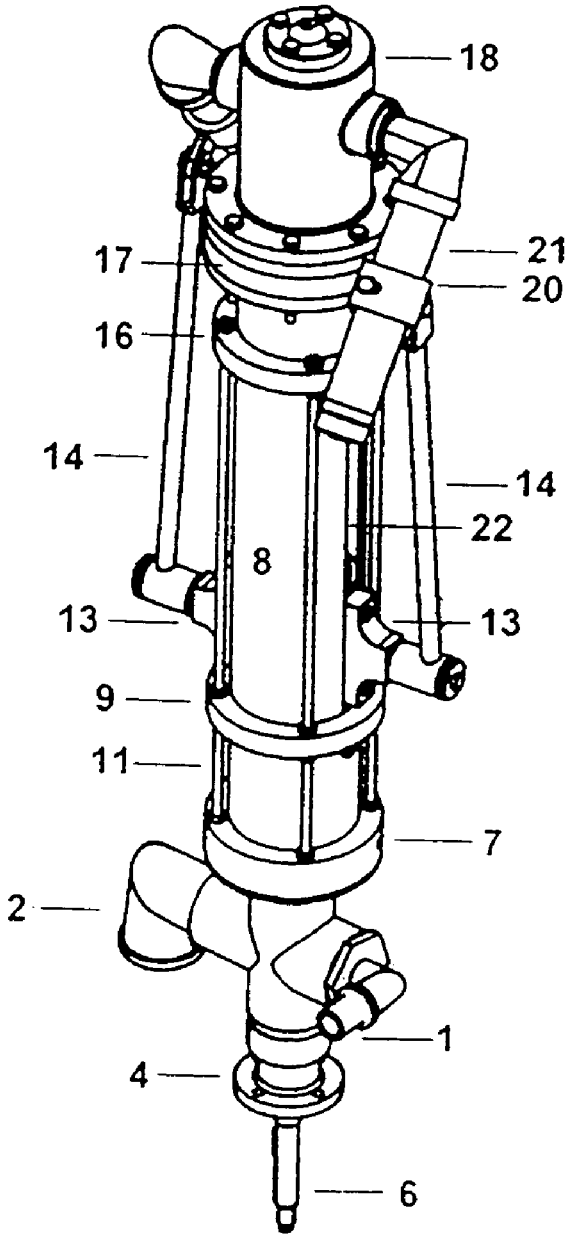
FIG. 4 Shows three dimensional view of an embodiment with two nozzle-arms (arms not shown in full length)

It is possible to limit the embodiment to two nozzle-arms i.e. to the upper arms (21), as shown in FIG. 4, or even to a pair (15, 21).

When in use, according to the method of the invention, cleaning-medium is led into the inlet-pipe (1) that flows into the continuation of the inlet-pipe (10) into, the distributor (18) and then all the way to the nozzle-arms (15, 21) and the nozzles. When the motor (3) is turned on, the drive-shaft (6) rotates as well as the shielding-pipe/distributor (8/18) together with the nozzle-arms (15, 21). The rotation results in movement of the vertical displacement nut (12) either upwards or downwards, depending on the direction of rotation of the motor (3). The nozzle-arms (15, 21) move similarily either upwards or downwards in a circular movement. The vertical movement is limited by detectors/stop-rings (9,16) because when the vertical displacement nut (12) contacts the rings (9,16) a signal is transmitted to the contacting-ring (7) that in turn transmits a signal to the switch (5) which changes the rotation of the motor (3). It is possible to vary the vertical displacement and the rate of the displacement by altering the distance between the rings (9,16) and/or the position of the clips (20) on the upper nozzle-arm (21), hence the angle between the vertical displacement-arms (14) and the shielding-pipe (8). Optionally, the direction of rotation and the number of rotations can be controlled from outside of the space e.g. by a computer. The method allows exact control of nozzles and every part of the space will be cleaned in detail.

Although the apparatus was originally constructed for cleaning storage tanks of different kinds, it is also suitable for cleaning other types of spaces such as containers, ships holds or pipes. In addition, it is also ideal for use when spraying tanks with protective agents such as anti-oxidants and anti-corrosives.

The cleaning-medium can be of different kinds; fluid or gas and even sand. By recycling, the activity of the cleaning-medium can be utilized to the utmost. Also, the cleaning-medium can optionally be refined e.g. outside the enclosed space to be cleaned. Furthermore, the temperature and the pressure of the cleaning-medium can be controlled.

REFERENCE NUMBERS USED IN THE FIGURES

1. Inlet-pipe
2. Fastening-flange
3. Motor
4. Connecting-flange
5. Switch
6. Drive shaft
7. Contacting-ring
8. Shielding-pipe
9. Stop-ring
10. Thread
11. Pin
12. Vertical displacement nut
13. Fastening-bolt
14. Vertical displacement arms
15. Lower nozzle-arms
16. Stop-ring
17. Sealing-contactor
18. Distributor
19. Swivel
20. Clip
21. Upper nozzle-arms
22. Slit

The invention claimed is:

1. An apparatus for cleaning an enclosed space comprising:

an inlet-pipe for transporting cleaning-medium, having a thread on the outside of the inlet-pipe, a shielding-pipe, rotatable relative to the inlet-pipe, in close but spaced relation to, and surrounding, the inlet-pipe, and having a longitudinal opening through a surface of the shielding-pipe along at least a portion of its length, a cleaning-medium distributor at one end of the inlet-pipe, upper and lower nozzle-arms in fluid communication with the cleaning-medium distributor, a rotatable drive shaft extending through the inlet-pipe and operably connected to the cleaning-medium distributor, a controllable motor for rotating the drive shaft, a displacement nut to operably engage the thread on the inlet-pipe, the displacement nut being accessible through the longitudinal opening in the surface of the rotatable shielding-pipe, and displacement arms to operably connect the displacement nut to the upper nozzle-arms, wherein the nozzle-arms are arranged and constructed to move vertically and circularly in concert with the displacement nut when the motor rotates the drive shaft.

2. The apparatus according to claim 1 wherein the motor is an electric, pneumatic or hydraulic motor.

3. The apparatus according to claim 1 or 2, further comprising a control device to control the motor and elements that detect displacement of the displacement nut and transmit a signal to a switching device that controls the motor.

4. The apparatus according to claim 1 or 2 wherein the rotation of the motor is controlled from outside of the enclosed space.

5. The apparatus according to claim 1 or 2 wherein the displacement arms are adjustable in length.

6. The apparatus according to claim 1 or 2 wherein the nozzle-arms are adjustable in length.

7. The apparatus according to claim 1 wherein the only nozzle-arms are those connected to the displacement arms.

* * * * *